US006652598B1

(12) United States Patent
Shibata et al.

(10) Patent No.: US 6,652,598 B1
(45) Date of Patent: Nov. 25, 2003

(54) PROCESS FOR THE TREATMENT OF WEFT KNITTED FABRICS

(75) Inventors: Mari Shibata, Sakai (JP); Masanori Nakagawa, Nagaokakyo (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 09/582,922

(22) PCT Filed: Jan. 8, 1999

(86) PCT No.: PCT/JP99/00027

§ 371 (c)(1),
(2), (4) Date: Jul. 7, 2000

(87) PCT Pub. No.: WO99/35324

PCT Pub. Date: Jul. 15, 1999

(30) Foreign Application Priority Data

Jan. 8, 1998 (JP) ..... 10/002618

(51) Int. Cl.[7] ..... D06M 13/00; D06M 11/00

(52) U.S. Cl. ..... 8/115.51; 8/116.1; 8/181; 8/188; 8/115.6; 8/115.7

(58) Field of Search ..... 8/115.51, 116.1, 8/181, 188, 115.6, 115.7

(56) References Cited

U.S. PATENT DOCUMENTS 5,443,776 A * 8/1995 Bartholomew et al. ..... 264/168

5,470,519 A * 11/1995 Markulin ..... 264/193

FOREIGN PATENT DOCUMENTS

| | | |
|---|---|---|
| DE | 30 02 324 A1 | 7/1981 |
| EP | 0068748 | 1/1983 |
| JP | 2-127052 | 10/1938 |
| JP | 60-40102 | 3/1985 |
| JP | 6-166956 | 6/1994 |
| JP | 7-292582 | 11/1995 |
| JP | 8-291470 | 11/1996 |
| WO | 95/24524 | 9/1995 |
| WO | 97/08370 | 3/1997 |

OTHER PUBLICATIONS

"Mercerisieren" 1995, Prof. Dr. H.–K. Rouette "Lexikon für Textilveredlung" Dülmen, pp. 1211–1220, with English translation.

* cited by examiner

*Primary Examiner*—Yogendra N. Gupta
*Assistant Examiner*—D G Hamlin
(74) *Attorney, Agent, or Firm*—Finnegan, Henderson, Farabow, Garrett & Dunner, L.L.P.

(57) ABSTRACT

The present invention relates to a method for treating a weft knitted fabric containing a regenerated cellulose fiber in order to prevent or eliminate the weft bar of the fabric, as well as to a weft knitted fabric which has been subjected to such a method. A method for treatment of weft knitted fabric, which comprises applying a mellowing treatment to a weft knitted fabric containing a regenerated cellulose fiber and subjecting the resulting weft knitted fabric to an alkali treatment in its spread state.

11 Claims, 1 Drawing Sheet

PROCESS FOR THE TREATMENT OF WEFT KNITTED FABRICS

TECHNICAL FIELD

The present invention relates to a method for treating a weft knitted fabric containing a regenerated cellulose fiber, as well as to a weft knitted fabric.

BACKGROUND ART

Weft knitted fabrics containing a regenerated cellulose fiber have had a problem in that they tend to generate weft bar owing to the variation in configuration and color difference and, as a result, become a product of strikingly low quality.

Hence, investigation has been made on knitting conditions, or, it has been attempted to minimize the variation in yarn quality, or, inspection of weft bar has been made at the stage of gray fabric. However, with the control of knitting conditions and yarn quality alone, it is impossible to prevent the generation of weft bar; further, even if weft bar is at a level giving substantially no problem, in the inspection of gray fabric, the weft bar often appears after dyeing. Nevertheless, no effective means has been found which can eliminate or prevent weft bar.

For improvement of the appearance of cellulose fiber fabric, there is disclosed, in WO 95/24524, mercerization of a fabric comprising a Lyocell fiber. This treatment comprises treating said fabric under tension in an aqueous solution containing a high concentration (10 to 30% by weight) of sodium hydroxide. The treatment aims at improving the appearance of said fabric, particularly the appearance of its surface having friction marks which looks like being covered with frost. In applying this treatment to a regenerated cellulose fiber, however, there has been a problem in that striking reduction in strength takes place, the treated fabric is impaired, its hand is hardened, and the appearance is impaired strikingly.

WO 97/8370 relates to a Lyocell fiber multifilament yarn and the improvement of wrinkles of a fabric comprising the yarn, and discloses treating said fiber under tension in a swelling agent or solvent containing said fiber in a concentration of 50 to 150 g/liter (about 4.8 to 13.1% by weight). In treating a regenerated cellulose fiber by this method, however, there has been a problem in that reduction in strength takes place, the hand becomes hard, and the properties and appearance of the fiber are impaired strikingly.

JP-A-6-166956 relates to a woven fabric or knitted fabric of a regenerated cellulose/polyester composite yarn and a method for production thereof, and discloses untwisting said woven fabric or knitted fabric by a relaxation treatment and then applying an alkali treatment to allow the regenerated cellulose fiber in the woven fabric or knitted fabric to generate fibril. In the production method of JP-A-6-166956, there are descriptions of "The relaxation treatment is conducted at 100 to 135° C. for 2 to 60 minutes using a jet dyeing machine" and "The alkali treatment is necessary for reducing the polyester fiber moiety by 3 to 30% by weight, and in Examples, an alkali treatment is conducted with an aqueous solution containing, for example, 2.8, 4.1 or 14.7 g/liter of sodium hydroxide, using a jet dyeing machine". Judging from these descriptions, it is apparent that the alkali treatment is conducted in a rope state and not in a spread state.

With this method, there is obtained no effect of setting a regenerated cellulose fiber in a strain-free state, and no effect for improvement of bar is expectable.

In JP-A-8-291470 is described a method for prevention of friction marks, which comprises subjecting, to an alkali treatment, a cellulose fiber spun using an organic solvent or a fabric of the cellulose fiber in its spread state and then treating the resulting fiber or fabric with an aqueous solution containing a glyoxal type resin. In the literature, there is a description of "The alkali treatment is conducted with an aqueous alkaline solution containing 50 to 90 g/liter of sodium hydroxide, at 5 to 60° C. for 20 seconds to 2 minutes in a spread state". However, the literature makes no mention of mellowing treatment in the method for production of the fiber or fabric.

Regarding the prevention and elimination of the weft bar which appears easily in weft knitted fabrics containing a regenerated cellulose fiber, there is no description in any of WO 95/24524, WO 97/8370, JP-A-6-166956 and JP-A-8-291470; and no solution is given by any conventional technique. Thus, weft knitted fabrics containing a regenerated cellulose fiber have a problem in practical application.

DISCLOSURE OF THE INVENTION

Figure 1:
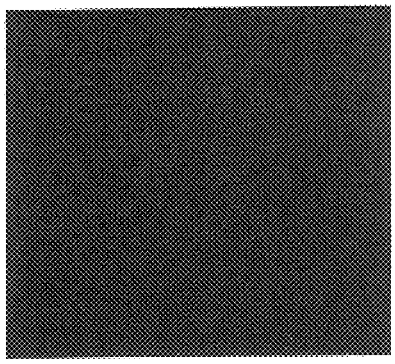
FIG. 1 is a photograph of a fabric which was treated and then dyed in Example 1.

The present invention aims at providing a weft knitted fabric containing a regenerated cellulose fiber, which has no weft bar.

In order to achieve the above aim, the present inventors made a study on the mechanism in which weft bar is generated. As a result, the present inventors found out that the weft bar of a weft knitted fabric can be greatly prevented or eliminated by relaxing or removing the strain of the loops of the weft knitted fabric and applying a heat treatment and an alkali treatment to the weft knitted fabric to set the structure of the weft knitted fabric and the fine structure of the fiber contained in the weft knitted fabric. The present invention has been completed based on the above finding.

The present invention lies in a method for treatment of weft knitted fabric, which comprises applying a mellowing treatment to a weft knitted fabric containing a regenerated cellulose fiber and subjecting the resulting weft knitted fabric to an alkali treatment in its spread state.

BEST MODE FOR CARRYING OUT THE INVENTION

In the present invention, "weft bar" of weft knitted fabric is different from the pattern of the weft knitted fabric determined by the design and refers to streak-like or stripe-like color unevenness or unevenness of yarn which appears along a particular yarn fed.

In the present invention, "prevention of weft bar" refers to prevention of the generation of weft bar so that no weft bar appears in a weft knitted fabric during or after its dyeing; and "elimination of weft bar" refers to substantially complete elimination or elimination to a practically acceptable level, of weft bar which has been generated at the stage of gray fabric or after the dyeing.

The weft knitted fabric used in the present invention is a circular knitted fabric or flat knitted fabric containing a regenerated cellulose fiber, such as cuprammonium rayon, viscose rayon, polynosic rayon or the like. The content of the regenerated cellulose fiber in the weft knitted fabric differs depending upon the application purpose of the weft knitted fabric but, in order to obtain, for example, a weft knitted fabric of cellulose touch and appearance, is preferably at least 30% by weight or more, more preferably 50% by weight or more, particularly preferably 70% by weight or more, most preferably 100% by weight. When a regenerated cellulose fiber is composed with a natural fiber (e.g. cotton or hemp) or a synthetic fiber (e.g. polyester type, polyamide type, polyacrylic type or polyurethane type elastic fiber), they can be blended, combined, twisted, or mixed on a knitting machine.

The fineness of the fiber is preferably 50 to 150 deniers. The gauges of the knitting machine is preferably 22 to 40 gauges, more preferably 22 to 32 gauges in the case of circular knitted fabric, and preferably 1.5 to 22 gauges, more preferably 14 to 18 gauges in the case of flat knitted fabric.

"Mellowing treatment" means to mellow a fabric containing a regenerated cellulose fiber, physically and positively in a state that the moisture content in the regenerated cellulose fiber is at least a standard moisture regain, preferably 20% or more, more preferably 40% or more. The purpose of the mellowing treatment is to correct the deformation of stitches appearing during knitting, caused by change of loop shape, non-uniformity in filament collection, etc., to obtain a strain-free knit structure. "Mellow physically and positively" means to mellow positively using an impact such as air flow, liquor flow or the like. The impact may be high frequency, an ultrasonic or the like applied in a liquid. The apparatus for conducting a mellowing treatment may be a continuous or batch type as long as it enables sufficient mellowing of fabric in a wet state; however, an apparatus is preferred which can mellow a fabric in a state that no excessive tension is applied to the fabric. As an apparatus of physically high mellowing effect, there can be mentioned, for example, a liquor flow dyeing machine, an air flow dyeing machine, a rotary dyeing machine, a wince dyeing machine, a washer, etc. The treatment using a relaxer (e.g., continuous scouring machine) of low mellowing effect is not included in the mellowing treatment of the present invention. Incidentally, it is possible that a fabric is immersed in water beforehand and, while being mellowed in a wet state, the fabric is continuously dried gradually using a tumbler.

The temperature of the mellowing treatment is preferably 20 to 120° C., more preferably 60 to 100° C. When the temperature is lower than 20° C., sufficient mellowing effect is obtained hardly. When the temperature is higher than 120° C., the regenerated cellulose fiber after mellowing partially has friction marks, etc. and its appearance may be impaired.

The time of the mellowing treatment is preferably 10 minutes to 2 hours, more preferably 30 minutes to 1 hour. When the time is shorter than 10 minutes, sufficient mellowing effect is obtained hardly. When the time is longer than 2 hours, the regenerated cellulose fiber after mellowing partially has friction marks, etc. and its appearance may be impaired. Scouring during mellowing using the same apparatus results in simplification of steps.

"Alkali treatment in spread state" means to contact a fabric with an aqueous alkaline solution in its spread state. The contact may be conducted by impregnation of a fabric with an aqueous alkaline solution or by spraying of an aqueous alkaline solution to a fabric. The contact by impregnation is preferred.

As the alkali agent used in the aqueous alkaline solution, there can be mentioned sodium hydroxide, potassium hydroxide, sodium carbonate, potassium carbonate, sodium silicate, etc. The concentration of the alkali agent in the aqueous alkaline solution is preferably 3 to 10% by weight, more preferably 5 to 8% by weight. When the concentration is less than 3% by weight, the effect of prevention and elimination of weft bar may not be sufficient. When the concentration is more than 10% by weight, the resulting fabric has a large variation in strength and hardly has a strength acceptable in product.

The temperature of the aqueous alkaline solution when used for the alkali treatment, is preferably 20 to 80° C. When the temperature is lower than 20° C., a large reduction-in strength may appear. When the temperature is higher than 80° C., yellowing may appear. Therefore, such temperatures are not preferred.

The contact with the aqueous alkaline solution is preferably conducted using, for example, a spreading machine such as continuous scouring machine, mercerizer or the like.

The "spread state" in the alkali treatment refers to a state in which a weft knitted fabric is spread. The tension which a weft knitted fabric receives in a spread state, is preferably such a low tension that the wrinkles of a weft knitted fabric after heat treatment are smoothed out. It is preferably, for example, such a tension that a fabric after mellowing treatment is finished in a range of −10% to 10% relative to the width and length of gray fabric.

The time of contact with the aqueous alkaline solution is preferably 10 seconds to 3 minutes. When the time is shorter than 10 seconds, treatment non-uniformity takes place easily. When the time is longer than 3 minutes, a large reduction in strength may take place.

In a more preferred mode of the alkali treatment, the temperature of weft knitted fabric before its contact with an aqueous alkaline solution is kept at 20 to 80° C. in order to conduct the treatment stably without being influenced by the temperature, humidity, etc. of the atmosphere. Further, the moisture content of the regenerated cellulose fiber in a weft knitted fabric before contact with an aqueous alkaline solution is controlled at a specified level or higher, preferably 20% or higher. The state of a weft knitted fabric when the weft knitted fabric is subjected to temperature and moisture content control prior to its contact with an aqueous alkaline solution, is not particularly restricted but is preferably a spread state.

In the most preferred mode of the alkali treatment, a weft knitted fabric before contact with an aqueous alkaline solution is immersed in a hot water in its spread state (this immersion is hereinafter referred to as prewetting treatment) and then contacted with an aqueous alkaline solution continuously.

The temperature in the prewetting treatment is set preferably at 20 to 80° C., more preferably at the same temperature as or a temperature not lower than the temperature of the aqueous alkaline solution in the alkali treatment. The time of immersion in the prewetting treatment is preferably 0.1 second to 3 minutes.

After the contact with an aqueous alkaline solution, neutralization and water washing are conducted for removal of alkali. The temperature employed in the neutralization and water washing is set preferably at 10 to 80° C., most preferably at not lower than the temperature of the aqueous alkaline solution in the alkali treatment. When the temperature is lower than 10° C., the alkali agent in the alkaline solution remains in the resulting weft knitted fabric and may cause the strength reduction and/or yellowing of the weft knitted fabric. Neutralization and water washing at a temperature up to 80° C. is sufficient for alkali removal.

Preferably, a heat treatment is conducted simultaneously with and/or after the mellowing treatment. More preferably, a heat treatment is conducted after the mellowing treatment. Most preferably, a heat treatment is conducted between the mellowing treatment and dyeing. The heat treatment may be conducted a plurality of times during and/or after the mellowing treatment.

"Heat treatment" refers to thermal setting of a fabric in a strain-free state. The heat treatment may be conducted in a spread state, or using an air current dryer, a tumbler or the like; however, it is preferably conducted in a spread state using a pin tenter or the like.

"Spread state" in the heat treatment refers to a spread state of a weft knitted fabric. The tension which a weft knitted fabric of spread state receives, is preferably such a low tension that the wrinkles of a weft knitted fabric after mellowing treatment are smoothed out.

In the heat treatment of a weft knitted fabric consisting of 100% of a regenerated cellulose fiber, the treating temperature is preferably 80 to 150° C. so that the regenerated cellulose fiber can be set in a strain-free state before the alkali treatment. The treating time is preferably 15 seconds to 30 minutes; however, at least 15 seconds of treatment is preferred after the fabric has been dried and reached the set temperature. When a weft knitted fabric consisting of 100% of a regenerated cellulose fiber is beforehand immersed in water and then dried, while being mellowed, at 80 to 150° C. using a tumbler or the like, the mellowing treatment and the heat treatment can be conducted simultaneously.

In the heat treatment of a weft knitted fabric wherein a regenerated cellulose fiber is composed with a synthetic fiber, the heat treatment is conducted preferably in a spread state so that the synthetic fiber can be set in a stable state. The temperature used in the heat treatment differs depending upon the kind of the synthetic fiber, but is preferably not lower than the second-order transition temperature of the synthetic fiber but not higher than its softening point. The treating time is preferably 15 seconds to 5 minutes, more preferably 30 seconds to 2 minutes; however, when the fabric is in a wet state, at least 15 seconds of treatment is preferred after the fabric has been dried and reached the set temperature. For example, in the case of conjugation between a regenerated cellulose fiber and a polyester fiber, the heat treatment is conducted preferably at 170 to 190° C. for 1 to 3 minutes.

In the heat treatment of a weft knitted fabric wherein a regenerated cellulose fiber is composed with a synthetic fiber such as polyester type, polyamide type or the like, a heat treatment before the alkali treatment is preferred in order to set, before the alkali treatment, a regenerated cellulose fiber in a strain-free state and a synthetic fiber in a stable state.

However, in the case of a weft knitted fabric containing a regenerated cellulose fiber and, as a synthetic fiber, a polyurethane type elastic fiber, the heat treatment (this causes fusion bonding of the polyurethane type elastic fiber) and subsequent alkali treatment may reduce the surface quality of the fabric; therefore, in order to set the polyurethane type elastic fiber in a stable state, it is preferred that the fabric is subjected to an alkali treatment in its spread state and then to a heat treatment in its spread state.

As described above, the weft knitted fabric which has been subjected to the treating method of the present invention, when the regenerated cellulose fiber contained therein has an X-ray crystallinity of 45 to 60% and an X-ray crystal completeness of 0.15 to 0.30, is made substantially free from the internal strain applied during knitting and hardly generates weft bar during dyeing. When the X-ray crystallinity of regenerated cellulose fiber is less than 45% or when the X-ray crystal completeness is less than 0.15, the prevention and elimination of bar is insufficient. When the X-ray crystallinity is more than 60% or when the X-ray completeness is more than 0.30, the hand of the weft knitted fabric is rigid, making it impossible to obtain a cellulose touch and appearance intended by the present invention.

The present invention is described below more specifically by way of Examples. However, the present invention is not restricted to these Examples alone. In Table 1 are shown the density of gray fabric, density of final fabric, rating of weft bar, and crystallinity and crystal completeness of regenerated cellulose fiber, of each Example or each Comparative Example.

(1) Rating of Weft Bar

The degree of the weft bar of a fabric after treatments and dyeing was rated visually according to the following standard.

Grade 5: no bar is seen.

Grade 4: bar is seen depending upon the angle of vision.

Grade 3: bar is seen faintly (cyclic streak-like or stripe-like weft bar is seen slightly).

Grade 2: bar is seen at a glance (cyclic streak-like or stripe-like weft bar is seen at a glance).

Grade 1: Striking bar (cyclic streak-like or stripe-like weft bar is striking).

Grade 4 and above were judged to be as an acceptable level.

(2) Crystallinity of Regenerated Cellulose Fiber

Crystallinity was obtained by measuring an X-ray diffraction pattern by reflection method using an X-ray diffractometer (Rotor Flex Ru-200 PL, a product of Rigaku Denki K.K.) with a scintillation counter and making calculation using the measurement result. The measurement was conducted by separating a regenerated cellulose fiber from a fabric, finely cutting the separated fiber to make it into a powder (in order to eliminate the adverse effect of crystal orientation), and molding the powder into tablets. The crystallinity was obtained by selecting, in the X-ray diffraction pattern, an X-ray peak of $2\theta=12\pm1°$ corresponding to $(1\bar{1}0)$ face, drawing, as a base line therefor, a straight line (a tangent) connecting X-ray intensity points of $2\theta=10°$ and $2\theta=16°$, determining the maximum X-ray peak intensity (It) of $2\theta=12\pm1°$ and the height (Iu) of the tangent at $2\theta=12\pm1°$, and making calculation using the following formula (1) [see A. Isogai et al.: The Society of Fiber Science and Technology, Japan, Vol. 46, No. 8, 1990].

$$\text{X-ray crystallinity } (\%)=[(It-Iu)/It]\times100 \quad (1)$$

(3) Crystal Completeness of Regenerated Cellulose Fiber

Crystal completeness was obtained by making measurements in the same manner as for crystallinity and making calculation using the following formula (2).

$$\text{Crystal completeness}=1=2\times Ic/((Ia+Ib) \quad (2)$$

Ia: maximum X-ray intensity of $2\theta=20\pm1°$ corresponding to (110) face.

Ib: maximum X-ray intensity of $2\theta=22\pm1°$ corresponding to (020) face.

Ic: minimum X-ray intensity of $2\theta=21\pm1°$ Between (110) face and (020) face.

A larger value of the formula (2) indicates a higher crystal completeness. When the peaks of (110) face and (020) face are in complete separation from each other, the crystal completeness is 1; when the peaks are overlapping into one peak, the crystal completeness is 0.

(4) Fineness (Deniers) of Polyurethane Type Elastic Fiber

A polyurethane type elastic fiber was unwound from its cheese and subjected to humidity control at 20° C. at 65% R.H. for 24 hours, and a 1-m sample was collected from the resulting fiber in a strain-free and linear state and measured for the weight.

The measurement was conducted 10 times, an average thereof was calculated, and the fineness of the fiber was determined from the average using the following formula (3).

$$\text{Fineness (Deniers) of Polyurethane Type Elastic Fiber} = \text{weight average (g)} \times 9000 \quad (3)$$

EXAMPLE 1

A circular knitted fabric was produced from a cupra multifilament yarn of 75 deniers/45 filaments using a circular knitting machine of 26 gauges and 30 feeders, and was subjected to a mellowing treatment, a heat treatment, an alkali treatment and drying under the following conditions.

Treating Conditions

1. Mellowing Treatment

The circular knitted fabric was mellowed (this functioned also as scouring) in an aqueous anionic surfactant solution (0.5 g/liter) at 80° C. for 10 minutes using a jet dyeing machine, then water-washed, and dehydrated using a mangle.

2. Heat Treatment

The fabric after mellowing treatment was heat-treated at 100° C. for 5 minutes using a pin tenter, so as to obtain the same width and length as the gray fabric had.

3. Alkali Treatment

Using a mercerizer, the fabric after heat treatment was immersed in an aqueous solution containing 7% by weight of sodium hydroxide for 30 seconds, water-washed, then neutralized with an aqueous acetic acid solution adjusted to pH 4, water-washed, and dehydrated using a mangle. Incidentally, the temperatures employed in the alkali treatment, water washing, neutralization, and subsequent water washing were all 30° C.

4. Drying

The fabric after alkali treatment was dried at 100° C. for 5 minutes using a pin tenter so as to obtain the same width and length as the gray fabric had.

The fabric treated above was dyed at 90° C. in a dyeing bath containing 0.5% owf of Kayacelon Brown C-GL (a product of Nippon Kayaku Co., Ltd.) and 5 g/liter of Glauber's salt, using a jet dyeing machine. Here, "owf" means weight % of dye relative to fabric (fiber).

A photograph of the fabric after treatments and dyeing is shown in FIG. 1. No weft bar is seen on the surface of the fabric.

EXAMPLE 2

The same knitted fabric as in Example 1 was produced and subjected to a mellowing treatment, a heat treatment, a prewetting treatment, an alkali treatment and drying under the following conditions.

Treating Conditions

1. Mellowing Treatment

Same as in Example 1.

2. Heat treatment

Same as in Example 1.

3. Prewetting treatment

The fabric after heat treatment was immersed in hot water of 40° C. for 30 seconds.

4. Alkali treatment

The fabric after prewetting treatment was squeezed using a mangle and immediately subjected to the same alkali treatment as in Example 1.

5. Drying

Same as in Example 1.

The fabric treated above was dyed in the same manner as in Example 1.

EXAMPLE 3

The same knitted fabric as in Example 1 was produced and subjected to a mellowing treatment, a heat treatment, an alkali treatment and drying under the a following conditions.

Treating Conditions

1. Mellowing Treatment

The circular knitted fabric was mellowed (this functioned also as scouring) in an aqueous anionic surfactant solution (0.5 g/liter) at 80° C. for 30 minutes using a jet dyeing machine, then water-washed, and dehydrated using a mangle.

2. Heat Treatment

Same as in Example 1.

3. Alkali Treatment

Same as in Example 1.

4. Drying

Same as in Example 1.

The fabric treated above was dyed and dried in the same manner as in Example 1, then immersed in an aqueous solution containing 2% by weight of Nikka Silicone AMZ-3 (an amino-modified silicone type softening agent produced by Nikka Kagaku), dehydrated using a mangle, and dried.

EXAMPLE 4

The same knitted fabric as in Example 1 was produced and subjected to a mellowing treatment, a heat treatment, a prewetting treatment, an alkali treatment and drying under the following conditions.

Treating Conditdion

1. Mellowing Treatment

Same as in Example 3.

2. Heat Treatment

Same as in Example 1.

3. Prewettindg Treatment

Same as in Example 2.

4. Alkali Treatment

Same as in Example 2.

5. Drying

Same as in Example 1.

The fabric treated above was subjected to the same dyeing and softening treatment as in Example 3.

EXAMPLE 5

The same knitted fabric as in Example 1 was produced and subjected to a mellowing treatment, a heat treatment, an alkali treatment and drying under the following conditions.

Treating Conditions

1. Mellowing Treatment

Same as in Example 3.

2. Heat Treatment

The fabric after mellowing treatment was heat-treated at 80° C. for 30 minutes using a tumbler.

3. Alkali Treatment
Same as in Example 1.
4. Drying
Same as in Example 1.
The fabric treated above was subjected to the same dyeing and softening treatment as in Example 3.

EXAMPLE 6

The same knitted fabric as in Example 1 was produced and subjected to a mellowing treatment, an alkali treatment and drying under the following conditions.

Treating Conditions

1. Mellowing Treatment
Same as in Example 1.
2. Alkali Treatment
The fabric after mellowing treatment was squeezed using a mangle and immediately subjected to the same alkali treatment as in Example 1.
3. Drying
Same as in Example 1.
The fabric treated above was subjected to the same dyeing and softening treatment as in Example 3.

EXAMPLE 7

A circular knitted fabric was produced from a cupra multifilament of 75 deniers/45 filaments and a polyester multifilament of 75 deniers/36 filaments, using a circular knitting machine of 26 gauges and 30 feeders, and was subjected to a mellowing treatment, a heat treatment, an alkali treatment and drying under the following conditions.

Treating Conditions

1. Mellowing Treatment
Same as in Example 1.
2. Heat Treatment
The fabric after mellowing treatment was heat-treated at 180° C. for 2 minutes using a pin tenter, so as to obtain the same width and length as the gray fabric had.
3. Alkali Treatment
Same as in Example 1.
4. Drying
Same as in Example 1.
The fabric treated above was dyed at 130° C. in a dyeing bath containing 0.5% owf of Kayacelon Brown C-GL (a product of Nippon Kayaku Co., Ltd.), 0.5% owf of Kayalon Polyester Dark Brown AS-200 (a product of Nippon Kayaku Co., Ltd.), 1 g/liter of Disper TL (a product of Meisei Kagaku Kogyo K.K.) and 5 g/liter of Glauber's salt, using a jet dyeing machine.

EXAMPLE 8

The same knitted fabric as in Example 7 was produced and subjected to a mellowing treatment, a heat treatment, a prewetting treatment, an alkali treatment and drying under the following conditions.

Treating Conditions

1. Mellowing Treatment
Same as in Example 1.
2. Heat Treatment
Same as in Example 7.
3. Prewetting Treatment
Same as in Example 2.
4. Alkali Treatment
Same as in Example 2.
5. Drying
Same as in Example 1.
The fabric treated above was subjected to the same dyeing as in Example 7.

EXAMPLE 9

The same knitted fabric as in Example 7 was produced and subjected to a mellowing treatment, a heat treatment, an alkali treatment and drying under the following conditions.

Treating Conditions

1. Mellowing Treatment
The circular knitted fabric was mellowed (this functioned also as scouring) in an aqueous anionic surfactant solution (0.5 g/liter) at 100° C. for 30 minutes using a jet dyeing machine, then water-washed, and dehydrated using a mangle.
2. Heat Treatment
Same as in Example 7.
3. Alkali Treatment
Same as in Example 1.
5. Drying
Same as in Example 1.
The fabric treated above was dyed and dried in the same manner as in Example 7, then immersed in an aqueous solution containing 2% by weight of Nikka Silicone AMZ-3 (an amino-modified silicone type softening agent produced by Nikka Kagaku), dehydrated using a mangle, and dried.

EXAMPLE 10

The same knitted fabric as in Example 7 was produced and subjected to a mellowing treatment, a heat treatment, a prewetting treatment, an alkali treatment and drying under the following conditions.

Treating Conditions

1. Mellowing Treatment
Same as in Example 9.
2. Heat Treatment
Same as in Example 7.
3. Prewetting Treatment
Same as in Example 2.
4. Alkali Treatment
Same as in Example 2.
5. Drying
Same as in Example 1.
The fabric treated above was subjected to the same dyeing and softening treatment as in Example 9.

EXAMPLE 11

A plain knitting was produced, which was composed of the bear yarn of a cupra multifilament of 100 deniers/60 filaments and a polyurethane multifilament of 30 deniers/3 filaments, using a circular knitting machine of 28 gauges and 60 feeders, and subjected to a mellowing treatment, an alkali treatment, a heat treatment and drying under the following conditions.

Treating Conditions

1. Mellowing Treatment
Same as in Example 1.
2. Drying
Same as in Example 1.
3. Alkali Treatment
Same as in Example 1.

4. Heat Treatment

The fabric after alkali treatment was heat-treated at 190° C. for 30 seconds using a pin tenter so as to obtain the same width and length as the gray fabric had.

The fabric treated above was subjected to the same dyeing and softening treatment as in Example 3.

COMPARATIVE EXAMPLE 1

The operation of Example 1 was repeated except that the alkali treatment and drying conducted in Example 1 were excluded.

Figure 2:
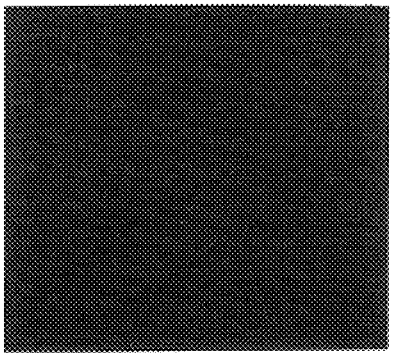
FIG. 2 is a photograph of a fabric which was treated and then dyed in Comparative Example 1.

A photograph of the fabric after treatments and dyeing, obtained above is shown in FIG. 2. Striking weft bar is seen on the surface of the fabric.

COMPARATIVE EXAMPLE 2

The operation of Example 1 was repeated except that the treatments were conducted in the order of alkali treatment, heat treatment and mellowing treatment.

Figure 3:
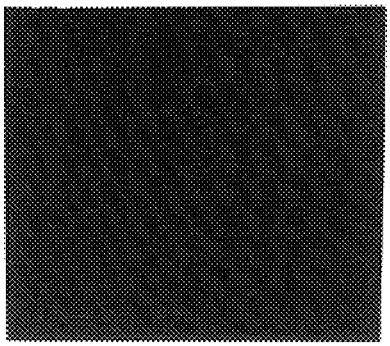
FIG. 3 is a photograph of a fabric which was treated and then dyed in Comparative Example 2.

A photograph of the fabric after treatments and dyeing, obtained above is shown in FIG. 3. Striking weft bar is seen on the surface of the fabric.

COMPARATIVE EXAMPLE 3

The same knitted fabric as in Example 1 was produced and subjected to scouring, heat treatment, alkali treatment and drying under the following conditions.

Treating Conditions

1. Scouring

A continuous relaxer kier was used which consisted of first and second kiers of suspension type and third to sixth kiers of open soaper type. Scouring of circular knitted fabric was conducted in the first and second kiers using an aqueous anionic surfactant solution (0.5 g/liter), and washing with hot water was conducted in the third to sixth kiers. The temperature in each kier was 80° C. and the total treating time was 10 minutes. Then, dehydration was conducted using a mangle.

2. Heat Treatment

Same as in Example 1.

3. Alkali Treatment

Same as in Example 1.

4. Drying

Same as in Example 1.

The fabric treated above was subjected to the same dyeing as in Example 1.

COMPARATIVE EXAMPLE 4

The operation of Example 7 was repeated except that the treatments were conducted in the order of heat treatment, alkali treatment, drying and mellowing treatment.

COMPARATIVE EXAMPLE 5

The operation of Example 9 was repeated except that the alkali treatment and the drying were excluded.

COMPARATIVE EXAMPLE 6

The operation of Example 9 was repeated except that the mellowing treatment and the heat treatment were excluded.

COMPARATIVE EXAMPLE 7

The operation of Example 9 was repeated except that the mellowing treatment was excluded.

COMPARATIVE EXAMPLE 8

The operation of Example 11 was repeated except that the alkali treatment was excluded.

TABLE 1

| | Density of gray fabric | Density of finished fabric | Rating of weft bar | Crystal-linity | Crystal completeness |
|---|---|---|---|---|---|
| Example 1 | 42/36 | 46/38 | Grade 5 | 57% | 0.23 |
| Example 2 | 42/36 | 45/39 | Grade 5 | 56% | 0.21 |
| Example 3 | 42/36 | 45/38 | Grade 5 | 58% | 0.22 |
| Example 4 | 42/36 | 45/38 | Grade 5 | 56% | 0.21 |
| Example 5 | 42/36 | 46/38 | Grade 4–5 | 57% | 0.22 |
| Example 6 | 42/36 | 45/38 | Grade 4 | 56% | 0.22 |
| Example 7 | 52/36 | 52/39 | Grade 4 | 51% | 0.19 |
| Example 8 | 52/36 | 51/39 | Grade 5 | 50% | 0.18 |
| Example 9 | 52/36 | 51/38 | Grade 5 | 52% | 0.19 |
| Example 10 | 52/36 | 51/39 | Grade 5 | 50% | 0.19 |
| Example 11 | 68/44 | 71/46 | Grade 4 | 56% | 0.22 |
| Comparative Example 1 | 42/36 | 46/38 | Grade 1 | 41% | 0.13 |
| Comparative Example 2 | 42/36 | 45/39 | Grade 1 | 56% | 0.22 |
| Comparative Example 3 | 42/36 | 45/39 | Grade 3 | 57% | 0.22 |
| Comparative Example 4 | 52/36 | 51/39 | Grade 2 | 51% | 0.18 |
| Comparative Example 5 | 52/36 | 51/39 | Grade 1 | 38% | 0.12 |
| Comparative Example 6 | 52/36 | 52/39 | Grade 2 | 50% | 0.17 |
| Comparative Example 7 | 52/36 | 52/39 | Grade 2 | 51% | 0.18 |
| Comparative Example 8 | 68/44 | 72/48 | Grade 2 | 40% | 0.12 |

INDUSTRIAL APPLICABILITY

The method for treatment of weft knitted fabric according to the present invention, as compared with conventional treatment methods, can prevent and eliminate the weft bar of a weft knitted fabric containing a regenerated cellulose fiber.

What is claimed is:

1. A method for the treatment of a weft knitted fabric, which comprises applying a mellowing treatment to a weft knitted fabric containing a regenerated cellulose fiber multifilament yarn on an apparatus that provides a high mellowing effect to the fabric selected from the group consisting of a liquor flow dyeing machine, an air flow dyeing machine, a rotary dyeing machine, a wince dyeing machine and a washer dyeing machine and subjecting the resulting weft knitted fabric in a spread state to an alkali treatment.

2. A method according to claim 1, wherein the weft knitted fabric is heat-treated simultaneously with and/or after the mellowing treatment.

3. A method according to claim 2, wherein the weft knitted fabric is heat-treated after the mellowing treatment, in its spread state.

4. A weft knitted fabric containing a regenerated cellulose fiber multifilament yarn having an X-ray crystallinity of 45 to 60% and an X-ray crystal completeness of 0.15 to 0.30.

5. A method according to claim 1, wherein the mellowing treatment of the weft knitted fabric is conducted using a machine which can give a physically high mellowing effect.

6. A method according to claim 1, wherein the alkali treatment is conducted with an aqueous alkaline solution containing 3 to 10% by weight of an alkali agent.

7. A method according to claim 6, wherein the temperature of the aqueous alkaline solution is 20 to 80° C.

8. A method according to claim 1, wherein the weft knitted fabric is subjected to a prewetting treatment before being subjected to the alkali treatment.

9. A method according to claim 1, wherein the regenerated cellulose fiber multifilament yarn is a cuprammonium rayon and/or viscose rayon multifilament yarn.

10. A method according to claim 1, wherein the weft knitted fabric contains at least 30 to 100% by weight of the regenerated cellulose fiber multifilament yarn.

11. A method according to claim 1, wherein a weft knitted fabric containing the regenerated cellulose fiber multifilament yarn and a polyurethane type elastic fiber is subjected to the mellowing treatment and the alkali treatment and then the resulting weft knitted fabric is heat-treated in its spread state.

* * * * *